US008824953B2

(12) United States Patent
Uchida et al.

(10) Patent No.: US 8,824,953 B2
(45) Date of Patent: Sep. 2, 2014

(54) PRINTING APPARATUS, SHEET PROCESSING APPARATUS, AND SHEET WINDING DEVICE

(75) Inventors: Kota Uchida, Kawasaki (JP); Manabu Kanazawa, Yokohama (JP); Masahito Yoshida, Shiki (JP); Tetsuhiro Nitta, Yokohama (JP); Takayuki Okamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 303 days.

(21) Appl. No.: 12/949,586

(22) Filed: Nov. 18, 2010

(65) Prior Publication Data

US 2011/0211897 A1 Sep. 1, 2011

(30) Foreign Application Priority Data

Feb. 26, 2010 (JP) ..... 2010-042340

(51) Int. Cl.

| | |
|---|---|
| ***G03G 15/00*** | (2006.01) |
| ***B65H 15/00*** | (2006.01) |
| ***B65H 29/62*** | (2006.01) |
| ***B41J 3/60*** | (2006.01) |
| ***G03G 15/23*** | (2006.01) |
| ***B65H 29/00*** | (2006.01) |

(52) U.S. Cl.

CPC ..... *B41J 3/60* (2013.01); *B65H 2301/122* (2013.01); *B65H 2301/5111* (2013.01); *B65H 29/62* (2013.01); *B65H 2404/147* (2013.01); *B65H 2301/414225* (2013.01); *G03G 15/237* (2013.01); *B65H 2404/1421* (2013.01); *B65H 2301/33312* (2013.01); *B65H 2403/731* (2013.01); *B65H 2404/742* (2013.01); *B65H 2404/7231* (2013.01); *B65H 29/008* (2013.01); *B65H 2701/1131* (2013.01); *B65H 2301/517* (2013.01); *B65H 2801/15* (2013.01); *B65H 2557/23* (2013.01); *B65H 2301/331* (2013.01)

USPC ..... 399/401; 399/402; 271/291

(58) Field of Classification Search

USPC ..... 399/401, 402; 400/188

See application file for complete search history.

(56) References Cited

U.S. PATENT DOCUMENTS

| | | | | | |
|---|---|---|---|---|---|
| 4,110,030 | A | * | 8/1978 | Knechtel | 399/203 |
| 4,496,142 | A | * | 1/1985 | Iwasaki | 271/3.03 |
| 4,699,368 | A | * | 10/1987 | Hiraoka et al. | 271/82 |
| 5,012,295 | A | * | 4/1991 | Ikkatai et al. | 399/384 |
| 5,300,183 | A | * | 4/1994 | DeCook | 156/555 |

(Continued)

FOREIGN PATENT DOCUMENTS

| | | | | | |
|---|---|---|---|---|---|
| JP | 55-006331 | A | | 1/1980 | |
| JP | 58005775 | A | * | 1/1983 | G03G 21/00 |

(Continued)

*Primary Examiner* — Nguyen Ha

(74) *Attorney, Agent, or Firm* — Canon USA, Inc., IP Division

(57) ABSTRACT

A device includes a winding rotary member having a cylindrical shape; a holder having a rotating member, which is provided in the vicinity of a cylindrical surface of the winding rotary member, capable of nipping and conveying the sheet; a first driving mechanism configured to rotate the winding rotary member; and a second driving mechanism configured to rotate the rotating member. The winding rotary member rotates with the sheet is nipped with the rotatable holder, whereby the sheet is wound around the winding rotary member.

18 Claims, 14 Drawing Sheets

(56) References Cited

U.S. PATENT DOCUMENTS

| | | | | | |
|---|---|---|---|---|---|
| 5,374,049 | A * | 12/1994 | Bares et al. | 271/186 |
| 5,732,632 | A * | 3/1998 | Oomoto et al. | 101/483 |
| 6,077,030 | A * | 6/2000 | Frochte et al. | 414/789.9 |
| 6,203,007 | B1 * | 3/2001 | Choi | 271/278 |
| 6,746,010 | B2 * | 6/2004 | Ozaki | 271/3.21 |
| 7,101,037 | B2 * | 9/2006 | Mihara et al. | 347/104 |
| 7,497,634 | B2 * | 3/2009 | Kohira | 400/642 |
| 7,536,133 | B2 * | 5/2009 | Kang | 399/124 |
| 2002/0060413 | A1 * | 5/2002 | Sato et al. | 271/216 |
| 2006/0165453 | A1 * | 7/2006 | Bokelman et al. | 399/401 |
| 2007/0280763 | A1 * | 12/2007 | Suzuki | 399/394 |
| 2008/0143044 | A1 * | 6/2008 | Hatano | 271/225 |

FOREIGN PATENT DOCUMENTS

| | | | | | |
|---|---|---|---|---|---|
| JP | 60044460 | A | * | 3/1985 | B65H 15/00 |
| JP | 01080569 | A | * | 3/1989 | B41J 13/00 |
| JP | 02085869 | A | * | 3/1990 | G03G 15/00 |
| JP | 02086571 | A | * | 3/1990 | B65H 85/00 |
| JP | 03030967 | A | * | 2/1991 | B65H 15/00 |
| JP | 07149009 | A | * | 6/1995 | B65H 15/00 |
| JP | 07157152 | A | * | 6/1995 | B65H 15/00 |
| JP | 9-194144 | A | | 7/1997 | |
| JP | 11249346 | A | * | 9/1999 | |
| JP | 2000247521 | A | * | 9/2000 | B65H 85/00 |
| JP | 2000247522 | A | * | 9/2000 | B65H 85/00 |
| JP | 2008068935 | A | * | 3/2008 | B41J 3/60 |
| JP | 2008-126530 | A | | 6/2008 | |

* cited by examiner

PRINTING APPARATUS, SHEET PROCESSING APPARATUS, AND SHEET WINDING DEVICE

BACKGROUND OF THE INVENTION

1. Field of the Invention

The present invention relates to a printing apparatus, a sheet processing apparatus, and a sheet winding device, which employ a continuous sheet.

2. Description of the Related Art

With Japan Patent Laid-Open No. 2008-126530, a printing apparatus has been disclosed, which uses a long continuous sheet wound in a rolled state to perform duplex printing on both sides of the sheet by the inkjet method. This device is configured wherein a sheet to be printed on the front face at a print unit is temporarily wound around a winding rotary member (second roll 40), both sides of the sheet is reversed, and the sheet is fed to the print unit again to print on the back face.

With Japan Patent Laid-Open No. 9-194144, a sheet winding device for winding a sheet in a rolled state thereupon has been disclosed. A slit is provided to the shaft surface of a winding shaft, and a friction clamper having multiple protrusions is provided to the inner portion of the slit. The leading edge of a sheet to be wound thereupon is inserted into the slit, and the winding shaft rotates in a state in which the sheet leading edge is held by the clamper.

SUMMARY OF THE INVENTION

With the apparatus according to Japan Patent Laid-Open No. 2008-126530, at the time of winding a sheet around the winding rotary member, unless the sheet leading edge is clamped in a sure manner, there is a concern that improper winding may occur on the sheet wound around the rotating member, such as occurrence of slack or wrinkles. However, with Japan Patent Laid-Open No. 2008-126530, no specific disclosure regarding recognition of a problem or a solution thereof has been made regarding this issue.

The device according to Japan Patent Laid-Open No. 9-194144 also has the following issues to be solved.

(1) Since a sheet leading edge is inserted into the slit including friction members, there is a possibility that the sheet may be inserted in a skewed manner, the sheet leading edge may jam in the middle of insertion, or the sheet leading edge may be damaged. Conversely, at the time of extracting a sheet from the slit as well, extraction may not be smoothly performed, and there is also a possibility that conveying resistance may be caused, or the sheet leading edge may be damaged.

(2) While a sheet leading edge is inserted into the slit, and holding of this is completed, upon the sheet continuously being fed in, there is a possibility that a loop (slack) may occur on the sheet as illustrated in FIG. 14, which prevents stable winding.

The present invention has been made based on the recognition of the above issues. The present invention provides a sheet winding device capable of winding a sheet thereupon in a sure manner, and a sheet processing apparatus or printing apparatus which includes this.

According to an aspect of the present invention, there is provided a device capable of winding a sheet thereupon, including: a winding rotary member having a cylindrical shape; a holder having a rotating member, which is provided in the vicinity of a cylindrical surface of the winding rotary member, capable of nipping and conveying a sheet; a first driving mechanism configured to rotate the winding rotary member; and a second driving mechanism configured to rotate the rotating member; wherein the winding rotary member rotates with the sheet is nipped by the holder, whereby the sheet is wound around the winding rotary member.

According to the present invention, a sheet winding device capable of winding a sheet thereupon in a sure manner, and a sheet processing apparatus or printing apparatus which includes this are realized.

Further features of the present invention will become apparent from the following description of exemplary embodiments with reference to the attached drawings.

DESCRIPTION OF THE EMBODIMENTS

Hereafter, embodiments of a printing apparatus using the inkjet method will be described. The printing apparatus of the present embodiment is a high-speed line printer which can handle both of simplex printing and duplex printing using a long continuous sheet (long continuous sheet longer than the length of repetition print units (also called one page or unit image) in the conveying direction). For example, this printing apparatus is adapted to a field for printing a great number of sheets in a print lab or the like. Note that, with the present Specification, even when multiple small images, letters, or blanks are mixed in a one print unit (one page) region, all included in this region are referred to as one unit image. That is to say, a unit image means one print unit (one page) in the event of successively printing multiple pages on a continuous sheet. The length of a unit image differs according to an image size to be printed. For example, with a photo of L size, the length in the sheet conveying direction is 135 mm, and with A4 size, the length in the sheet conveying direction is 297 mm.

The present invention may widely be applied to a printing apparatus such as a printer, a multi-function printer, a copying machine, a facsimile apparatus, a manufacturing device of various types of devices, and so forth. The print processing is not restricted to any method, and may be an inkjet method, electrophotography method, thermal transfer method, dot-impact method, liquid development method, or the like. Also, the present invention is not restricted to print processing, and may be applied to a sheet processing apparatus which subjects a continuous sheet to various types of processing (recording, processing, coating, irradiation, scanning, inspection, and so forth).

Figure 1:
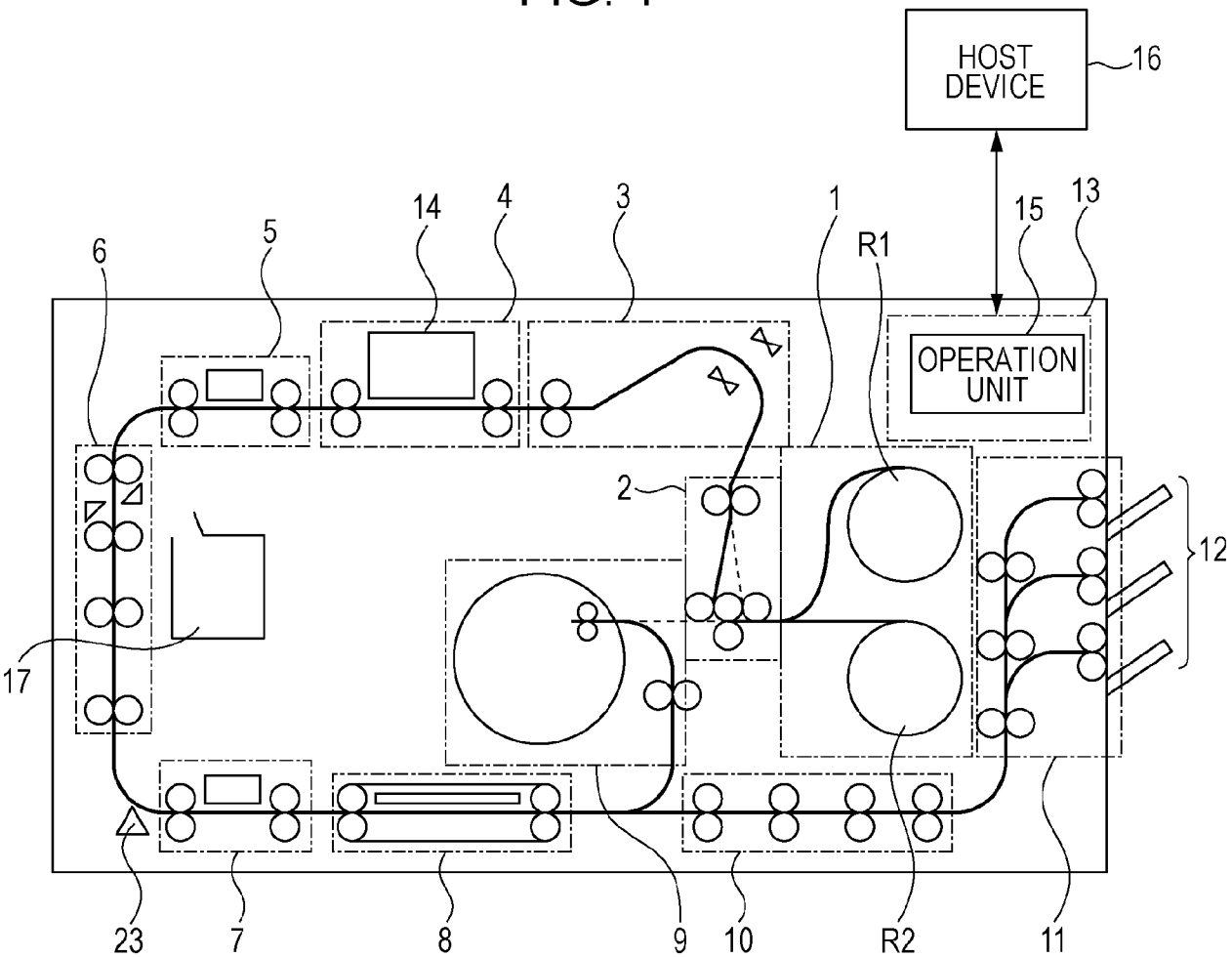
FIG. 1 is a schematic view illustrating the internal configuration of a printing apparatus.

FIG. 1 is a schematic view illustrating the internal configuration of the printing apparatus. The printing apparatus according to the present embodiment is capable of using a sheet wound in a rolled state to perform duplex printing on a first surface of the sheet and a second surface on the back face side of the first surface. The printing apparatus principally includes each unit of a sheet feeding unit 1, a decurling unit 2, a skew correcting unit 3, a print unit 4, an inspection unit 5, a cutter unit 6, an information recording unit 7, a drying unit 8, a reverse unit 9, a discharge conveying unit 10, a sorter unit 11, a discharge unit 12, and a control unit 13. The sheet is conveyed by a conveying mechanism made up of a roller pair and a belt and so forth along a sheet conveying path indicated with a solid line in the drawing, and is processed at each unit. Note that with an arbitrary position of the sheet conveying path, the side near the sheet feeding unit 1 is referred to as "upstream", and the opposite side thereof is referred to as "downstream".

The sheet feeding unit 1 is a unit for holding and feeding a continuous sheet wound in a rolled state. The sheet feeding unit 1 is capable of housing two rolls R1 and R2, and has a configuration for alternatively paying out sheets to be fed. Note that the number of rolls to be housed is not restricted to two, and one or three or more may be housed. The sheet is not restricted to a sheet wound in a rolled state as long as the sheet is a continuous sheet. For example, a sheet may be employed wherein a continuous sheet perforated for each unit length is folded and layered for each perforation, and is housed in the sheet feeding unit 1.

The decurling unit 2 is a unit for reducing curling (warping) of the sheet fed from the sheet feeding unit 1. With the decurling unit 2, curling is reduced by decurling force being influenced by passing through the sheet in a bent manner so as to provide the warping in the opposite direction using two pinch rollers as to one driving roller. The decurling unit 2 is capable of adjusting decurling force, which will be described later.

The skew correcting unit 3 is a unit for correcting skewing of the sheet having passed through the decurling unit 2 (angle as to the true direction of travel). Skewing of the sheet is corrected by pressing a sheet edge portion on the side serving as a reference against a guide member.

The print unit 4 is a sheet processing unit for subjecting a sheet to be conveyed to print processing by a print head 14 from above to form an image. That is to say, the print unit 4 is a processing unit for subjecting the sheet to predetermined processing. The print unit 4 also includes multiple conveying rollers to convey a sheet. The print head 14 includes a line-type print head where a nozzle train of the inkjet method is formed in a range covering the maximum width of a sheet to be used. With the print head 14, multiple print heads are arrayed in parallel along the conveying direction. With the present example, the print head 14 includes seven print heads corresponding to seven colors of C (cyan), M (magenta), Y (yellow), LC (light cyan), LM (light magenta), G (gray), and K (black). Note that the number of colors, and the number of print heads are not restricted to seven. As for the inkjet method, there may be employed a method using a heater element, a method using a piezo-electric element, a method using an electrostatic device, a method using an MEMS element, or the like. The ink of each color is supplied to the print head 14 via the corresponding ink tube from an ink tank. With the print unit 4, the print head 14 is arranged to be movable in a direction to be evacuated from the sheet, which will be described later. Thus, the interval of the print head 14 as to the sheet is adjusted.

The inspection unit 5 is a unit for optically scanning a test pattern or image printed on a sheet at the print unit 4 by a scanner to determine whether the image has correctly been printed by inspecting the states of the nozzles of the print head, sheet conveying state, image position, and so forth. The scanner includes a CCD image sensor or CMOS image sensor.

The cutter unit 6 is a unit including a mechanical cutter for cutting a sheet after printing into a predetermined length. The cutter unit 6 also includes multiple conveying rollers for feeding out the sheet to the next process. A trash box 17 is provided to the neighborhood of the cutter unit 6. The trash box 17 is for housing a small sheet piece to be cut off at the cutter unit 6 and discharged as trash. With the cutter unit 6, there is provided a sorting mechanism regarding whether the cut sheets are discharged to the trash box 17 or proceed to the original conveying path.

The information recording unit 7 is a unit for recording print information (unique information) in a non-print region of the cut sheet, such as the serial number or date or the like of printing. Recording is performed by printing characters or code by the inkjet method or thermal transfer method or the like. A sensor 23 for detecting the leading edge of the cut sheet is provided to the upstream side of the information recording unit 7 and the downstream side of the cutter unit 6. That is to say, timing for recording information at the information recording unit 7 is controlled based on the detection timing of the sensor 23 which detects the edge portion of a sheet between the cutter unit 6 and the recorded position by the information recording unit 7.

The drying unit 8 is a unit for heating the sheet printed by the print unit 4 to dry the applied ink in a short period of time. The sheet to be passed through is applied with heated air from at least the lower face side to dry the ink applied face within the drying unit 8. Note that the drying method is not restricted to the method for applying heated air, and may be a method for irradiating electromagnetic waves (such as an ultraviolet ray, infrared ray, or the like) on the sheet front face.

The above sheet conveying path from the sheet feeding unit 1 to the drying unit 8 will be referred to as a first path. The first path has a shape which performs a U-turn between the print unit 4 and the drying unit 8, and the cutter unit 6 is positioned in the middle of the U-turn shape.

The reverse unit 9 is a unit for temporarily winding the continuous sheet of which the front face printing has been completed thereupon to reverse both sides at the time of performing duplex printing. The reverse unit 9 is provided in the middle of a path (loop path) (referred to as "second path") from the drying unit 8 to the print unit 4 via the decurling unit 2 for feeding the sheet passed through the dying unit 8 to the print unit 4 again. The reverse unit 9 includes a winding rotary member (drum) which rotates for winding the sheet thereupon. The continuous sheet of which printing of the front face has been completed has not been cut is temporarily wound around the winding rotary member. At the time of winding being completed, the winding rotary member rotates in reverse, the sheet wound thereupon is fed out in the reverse order at the time of winding around the decurling unit 2, and is fed to the print unit 4. Both sides of this sheet have been reversed, so the back face can be printed at the print unit 4. More specific operation of duplex printing will be described later.

The discharge conveying unit 10 is a unit for conveying the sheet cut at the cutter unit 6 and dried at the drying unit 8 to transfer the sheet to the sorter unit 11. The discharge conveying unit 10 is provided to a path different from the second path where the reverse unit 9 is provided (referred to as "third path"). In order to selectively guide the sheet conveyed in the first path into any one of the second path and third path, a path switching mechanism having a movable flapper is provided to a branching position of the paths.

The sorter unit 11 and the discharge unit 12 are provided to the side portion of the sheet feeding unit 1 and also the tail end of the third path. The sorter unit 11 is a unit for classifying the printed sheet for each group as appropriate. The classified sheet is discharged to the discharge unit 12 made up of multiple trays. In this way, the third path has a layout where the sheet is passed through the lower side of the sheet feeding unit 1 and is discharged to the opposite side of the print unit 4 and the drying unit 8 sandwiching the sheet feeding unit 1.

The control unit 13 is a unit which manages control of each unit of the whole printing apparatus. The control unit 13 includes a CPU, a storage device, a controller including various types of control unit, an external interface, and an operation unit 15 by which a user performs input/output. The operation of the printing apparatus is controlled based on the command from a host device 16 such as a host computer to be connected to the controller directly or via the external interface.

Figure 2:
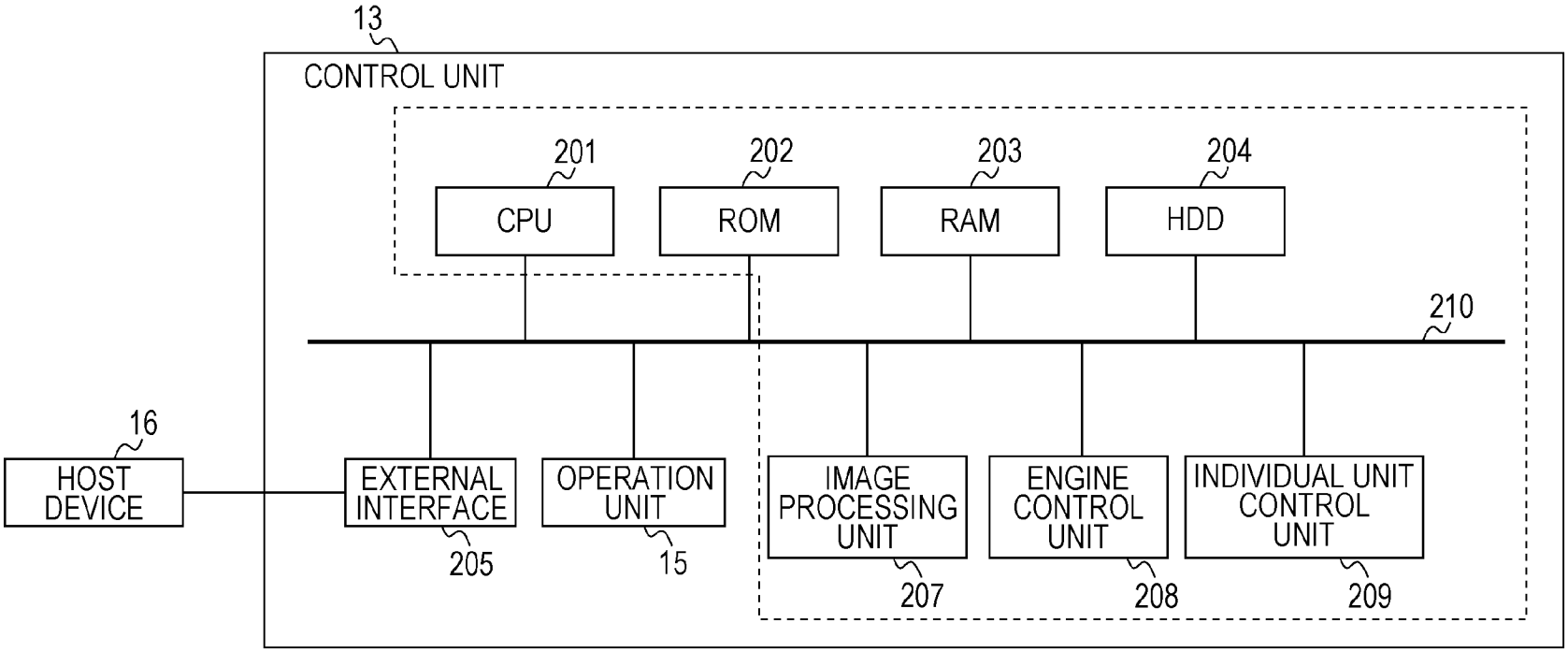
FIG. 2 is a block diagram of a control unit.

FIG. 2 is a block diagram illustrating the concept of the control unit 13. The controller included in the control unit 13 (range surrounded with a dashed line) is configured of a CPU 201, ROM 202, RAM 203, an HDD 204, an image processing unit 207, an engine control unit 208, and an individual unit control unit 209. The CPU 201 (central processing unit) centrally controls the operation of each unit of the printing apparatus. The ROM 202 stores a program to be executed by the CPU 201, and fixed data to be used for various types of operation of the printing apparatus. The RAM 203 is used as the work area of the CPU 201, or used as a temporarily storage region of various types of reception data, or used for storing various types of setting data. The HDD 204 (hard disk) can store or read out a program to be executed by the CPU 201, print data, and setting information used for various types of operation of the printing apparatus. The operation unit 15 is an input/output interface with the user, and includes an input unit such as a hard key or touch panel, and an output unit such as a display for presenting information, an audio generator, or the like.

A dedicated processing unit is provided regarding a unit which requires high-speed data processing. The image processing unit 207 performs the image processing of print data to be handled at the printing apparatus. The image processing unit 207 converts the color space of the input image data (e.g., YCbCr) into standard RGB color space (e.g., sRGB). Also, the image data is subjected to various types of image processing such as resolution conversion, image analysis, image correction, or the like as appropriate. The print data obtained by these image processes is stored in the RAM 203 or HDD 204. The engine control unit 208 performs driving control of the print head 14 of the print unit 4 according to the print data based on the control command received from the CPU 201 or the like. The engine control unit 208 further performs control of the conveying mechanism of each unit within the printing apparatus. The individual unit control unit 209 is a sub controller for individually controlling each unit of the sheet feeding unit 1, decurling unit 2, skew correcting unit 3, inspection unit 5, cutter unit 6, information recording unit 7, drying unit 8, reverse unit 9, discharge conveying unit 10, sorter unit 11, and discharge unit 12. The operation of each unit is controlled by the individual unit control unit 209 based on the command by the CPU 201. The external interface 205 is an interface for connecting the controller to the host device 16, and is a local interface or network interface. The above components are connected by a system bus 210.

The host device 16 is a device serving as the supply source of image data for causing the printing apparatus to perform printing. The host device 16 may be a general-purpose or dedicated computer, or may be dedicated image equipment such as an image capture having an image reader unit, a digital camera, photo storage, or the like. In the event that the host device 16 is a computer, OS, application software for generating image data, and a printer driver for printing apparatus are installed into a storage device included in the computer. Note that it is not essential that all of the above processes are realized by software, so part or all may be realized by hardware.

Next, basic operation at the time of printing will be described. With printing, the operation differs depending on the simplex print mode or the duplex print mode, so each will be described.

Simplex Print Mode

Figure 3A:
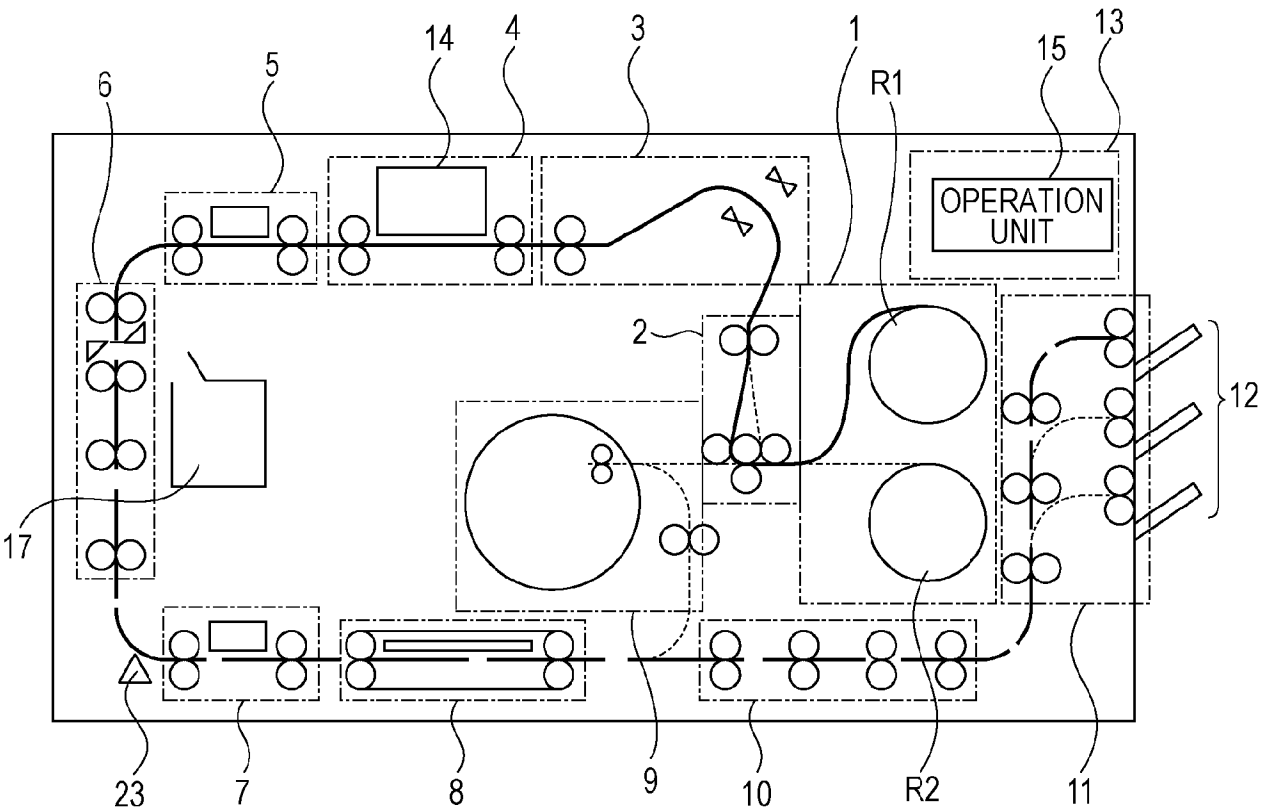
FIGS. 3A and 3B are diagrams for describing the operation in a simplex print mode and a duplex print mode.

FIG. 3A is a diagram for describing the operation in the simplex print mode. With the sheet fed from the sheet feeding unit 1, and processed at each of the decurling unit 2 and skew correcting unit 3, printing of the front face (first surface) is performed at the print unit 4. The image (unit image) of a predetermined unit length in the conveying direction is sequentially printed to array the multiple images as to the long continuous sheet. The printed sheet is cut for each unit image at the cutter unit 6 via the inspection unit 5. With the cut sheets, print information is recorded on the back faces of the sheets by the information recording unit 7 as appropriate. The cut sheets are conveyed to the drying unit 8 one sheet at a time, and are dried. Subsequently, the cut sheets are sequentially discharged to the discharge unit 12 of the sorter unit 11 via the discharge conveying unit 10, and are loaded. On the other hand, the sheets left behind to the print unit 4 side at the time of cutting of the last unit image is fed back to the sheet feeding unit 1, and the sheets are wound around the rolls R1 or R2. At the time of this feeding back, adjustment is performed so as to reduce decurling force at the decurling unit 2, and also the print head 14 is arranged to be evacuated from the sheet, which will be described later.

In this way, with simplex printing, the sheet is passed through the first path and the third path and is processed, but is not passed through the second path. If the above is summarized, with the simplex print mode, the following (1) through (6) sequence is executed by the control of the control unit 13.

(1) Feed out the sheet from the sheet feeding unit 1 to feed to the print unit 4.
(2) Repeat printing of a unit image on the first surface of the fed sheet at the print unit 4.
(3) Repeat cutting of the sheet at the cutter unit 6 for each unit image printed on the first surface.
(4) Pass the sheet cut for each unit image through the drying unit 8 one sheet at a time.
(5) Discharge the sheet passed through the drying unit 8 to the discharge unit 12 through the third path one sheet at a time.

(6) Feed the sheet left behind to the print unit 4 side by the last unit image being cut, back to the sheet feeding unit 1.

Duplex Print Mode

Figure 3B:
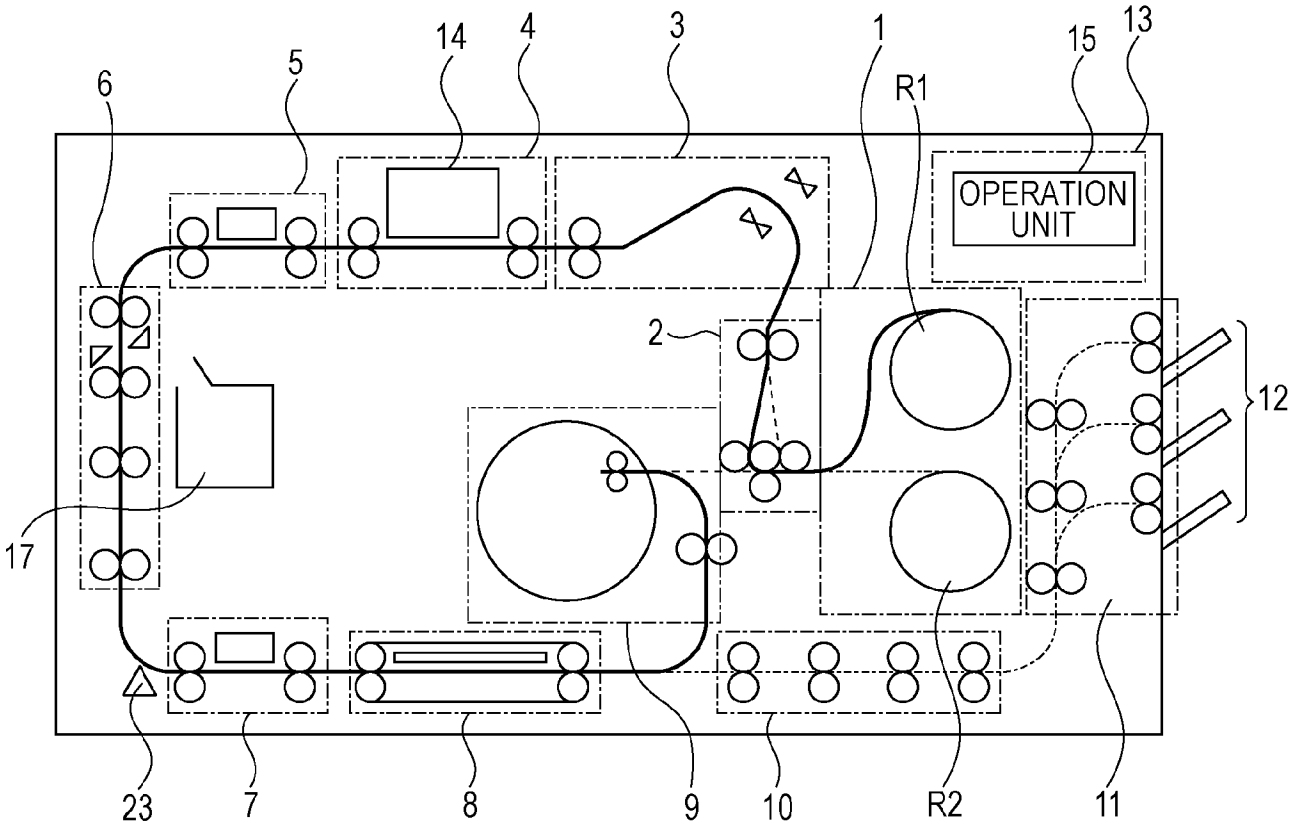

FIG. 3B is a diagram for describing the operation in the duplex print mode. With duplex printing, back face (second surface) print sequence is executed following the front face (first surface) print sequence. With the first front face print sequence, the operation at each unit from the sheet feeding unit 1 to the inspection unit 5 is the same as the operation of the above simplex printing. Cutting operation is not performed at the cutter unit 6, and the sheet is conveyed to the drying unit 8 still in the continuous sheet form. After ink drying of the front face at the drying unit 8, the sheet is guided not to the path on the discharge conveying unit 10 (third path) but to the path on the reverse unit 9 side (second path). With the second path, the sheet is wound around the winding rotary member of the reverse unit 9 which rotates in the forward direction (counter clockwise direction in the drawing). After the scheduled front face printing is all completed at the print unit 4, the trailing edge of the print region of the continuous sheet is cut at the cutter unit 6. The continuous sheet on the conveying direction downstream side (printed side) is all wound around up to the sheet trailing edge (cut position) at the reverse unit 9 through the drying unit 8 with the cut position as a reference. On the other hand, at the same time as the winding at the reverse unit 9, the continuous sheet left behind on the conveying direction upstream side (print unit 4 side) of the cut position is wound back to the sheet feeding unit 1 so that the sheet leading edge (cut position) is not left behind at the decurling unit 2, and the sheet is wound around the rolls R1 and R2. Collision with the sheet to be fed again in the following back face print sequence is avoided according to this winding back (back-feeding). At the time of this feeding back, adjustment is made so as to reduce decurling force at the decurling unit 2, and also the print head 14 is arranged to be evacuated from the sheet, which will be described later.

After the above front face print sequence, the front print sequence is switched to the back face print sequence. The winding rotary member of the reverse unit 9 rotates in the opposite direction (clockwise direction in the drawing) of the direction at the time of being wound thereupon. The edge portion of the sheet wound around (the sheet trailing edge at the time of being wound thereupon becomes the sheet leading edge at the time of being fed back) is fed to the decurling unit 2 along the path indicated with a dashed line in the drawing. Correction of curling applied by the winding rotary member is performed at the decurling unit 2. That is to say, the decurling unit 2 is a common unit which serves decurling in either path, provided between the sheet feeding unit 1 and the print unit 4 in the first path, and provided between the reverse unit 9 and the print unit 4 in the second path. The sheet of which both sides are inverted is fed to the print unit 4 via the skew correcting unit 3, where printing on the back face of the sheet is performed. The printed sheet is fed to the cutter unit 6 via the inspection unit 5, and is cut at the cutter unit 6 for each predetermined unit length. With the cut sheet, both sides are printed, so recording at the information recording unit 7 is not performed. The cut sheet is conveyed to the drying unit 8 one sheet at a time, and is sequentially discharged and loaded in the discharge unit 12 of the sorter unit 11 via the discharge conveying unit 10.

In this way, with duplex printing, the sheet is processing passing through the first path, second path, first path, and third path in this order. If the above is summarized, with the duplex print mode, the following (1) through (11) sequence is executed by the control of the control unit 13.

(1) Feed out the sheet from the sheet feeding unit 1 to feed to the print unit 4.

(2) Repeat printing of a unit image on the first surface of the fed sheet at the print unit 4.

(3) Pass the sheet of which the first surface is printed, through the drying unit 8.

(4) Lead the sheet passed through the drying unit 8 into the second path to wind the sheet around the winding rotary member included in the reverse unit 9.

(5) Cut the sheet at the cutter unit 6 at the end of the last printed unit image after repetition of printing as to the first surface.

(6) Wind the cut sheet around the winding rotary member until the edge portion of the cut sheet passes through the drying unit 8 and reaches the winding rotary member. Also, feed the sheet cut and left behind to the print unit 4 side, back to the sheet feeding unit 1.

(7) Rotate the winding rotary member in reverse after winding the sheet thereupon, and feed the sheet to the print unit 4 from the second path again.

(8) Repeat printing of a unit image on the second surface of the sheet fed from the second path at the print unit 4.

(9) Repeat cutting of the sheet at the cutter unit 6 for each unit image printed on the second surface.

(10) Pass the sheet cut for each unit image through the drying unit 8 one sheet at a time.

(11) Discharge the sheet passed through the drying unit 8 to the discharge unit 12 through the third path one sheet at a time.

Figure 4:
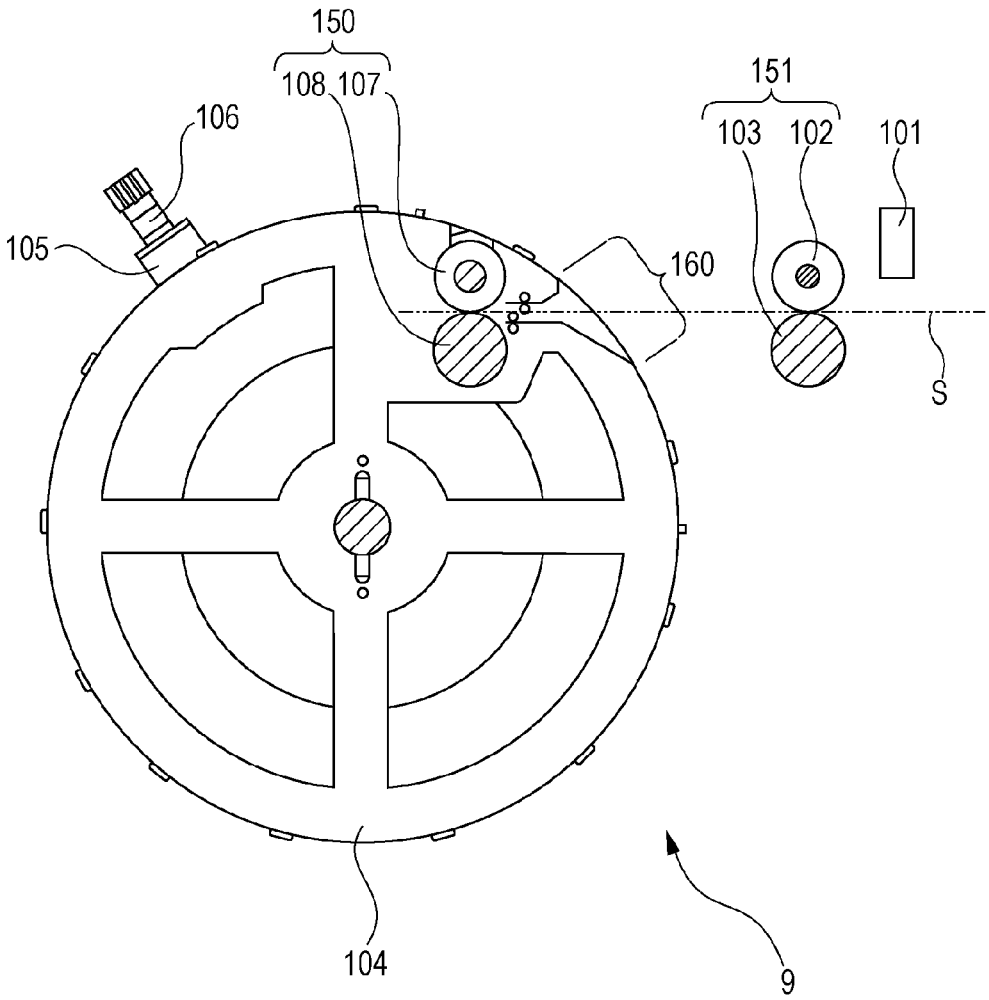
FIG. 4 is a cross-sectional view illustrating a configuration with a winding rotary member as the center.

Next, description will be made more in detail regarding the reverse unit 9 which is a characteristic portion of the printing apparatus having the above configuration. FIG. 4 is a cross-sectional view illustrating the configuration of the principal portions with the winding rotary member of the reverse unit 9 as the center. With a winding rotary member 104, at least of a portion of the internal portion has a hollow cylindrical shape (drum shape), and the cylindrical surface is a sheet winding face. Lead-in and discharge of the sheet S is performed as to the winding rotary member 104 by a conveying roller pair 151 made up of a conveying roller 102 and a pinch roller 103. an edge sensor 101 is provided in front of the conveying roller 102. The edge sensor 101 detects the leading edge of the sheet to be led into the reverse unit 9.

A holding roller pair 150 made up of a holding roller 108 and a pinch roller 107, which can nip a sheet leading edge and rotate the sheet, is provided to the neighborhood of the cylindrical surface of the winding rotary member 104 (the inner side of the cylindrical face which is a sheet winding face). The pinch roller 107 is pressed as to the holing roller 108 with predetermined force, and is driven-rotated. A sheet insertion unit 160 is formed in the shape of a slit on a portion of the winding face of the winding rotary member 104, and is inserted with the leading edge of the sheet S led in. The leading edge of the inserted sheet S is arranged to be nipped and held at the holding roller pair 150. Also, the inserted sheet is arranged to be able to be drawn into the internal space of the winding rotary member 104 by the holding roller being rotated. That is to say, the holding roller pair 150 has both of a function serving as a clamper for holding a sheet, and a function serving as a conveying unit for conveying a sheet.

Note that the holding roller 108 and the pinch roller 107 making up the holding roller pair 150 may both have driving force. Also, the holding roller 108 and the pinch roller 107 are not restricted to a mode having a roller shape, and one or both thereof may be a rotating member such as an endless belt rotating member. Alternatively, one may be a rotating member having driving force, and the other may be a simple sliding face. That is to say, it is a simple example that the holding roller pair 150 is configured of the holding roller 108 and the pinch roller 107, and as long as the holding roller pair 150 has a function to nip the leading edge of a sheet and also rotate the sheet to convey the sheet, a form thereof is not asked. With the present Specification, these various forms are collectively referred to as "rotatable holder".

A flag 105 is a member serving as a reference for detecting the origin (initial position) of the rotation position of the winding rotary member 104. A rotation sensor 106 is a sensor for detecting the rotation position of the winding rotary member 104. In FIG. 4, the position of the winding rotary member 104 is in an initial position, where the sheet insertion unit 160 faces the lead-in path of the sheet S.

A first driving mechanism for rotationally driving the winding rotary member 104 is provided to one of the side face sides of the winding rotary member 104. Also, a second driving mechanism for rotationally driving at least one roller (holding roller 108) making up the holding roller pair 150 is provided to the other side face side of the winding rotary member 104.

Figure 5A:
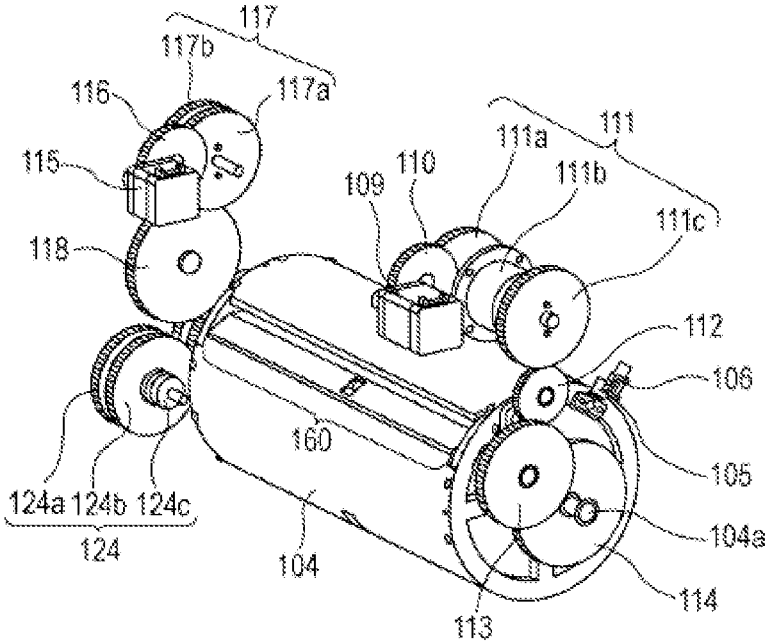
FIGS. 5A and 5B are perspective views illustrating the configuration of a driving mechanism of the winding rotary member.
Figure 5B:
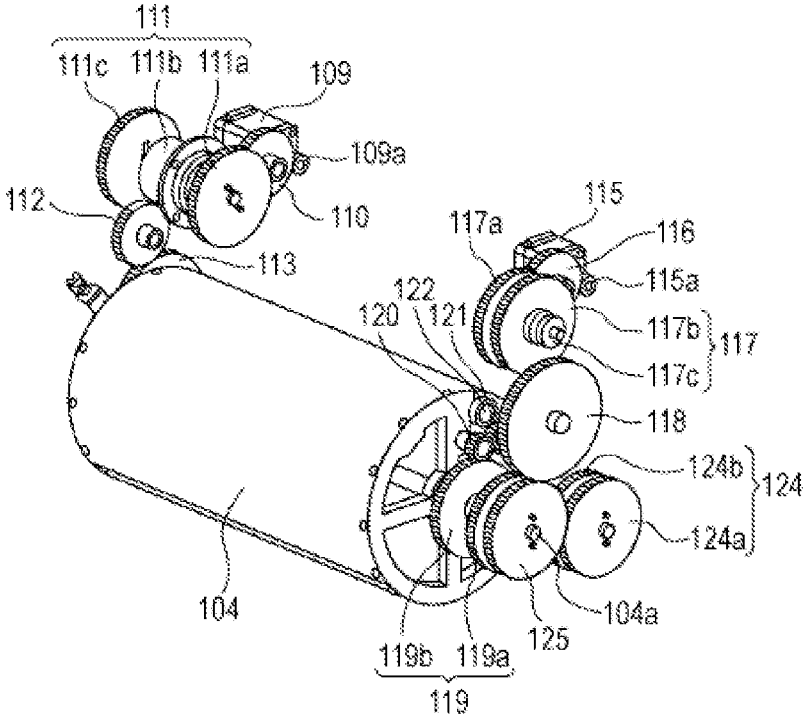
Figure 6A:
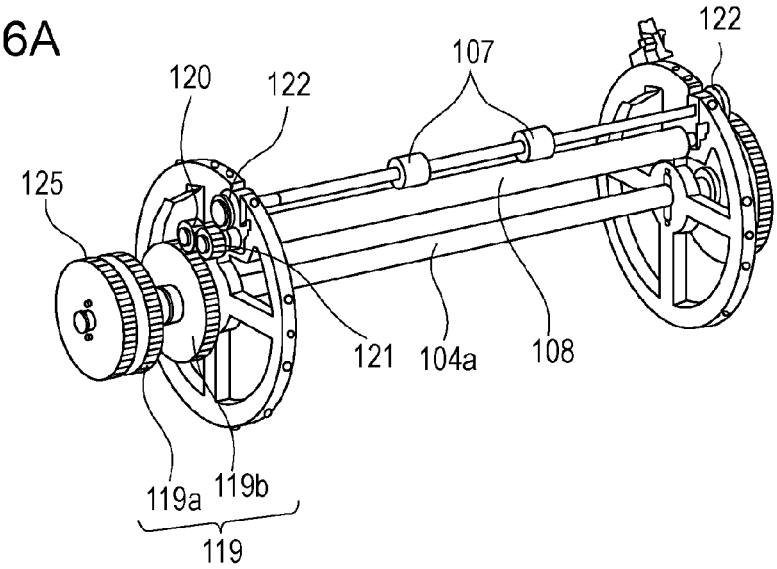
FIGS. 6A and 6B are diagrams illustrating the configuration of a second gear mechanism.
Figure 6B:
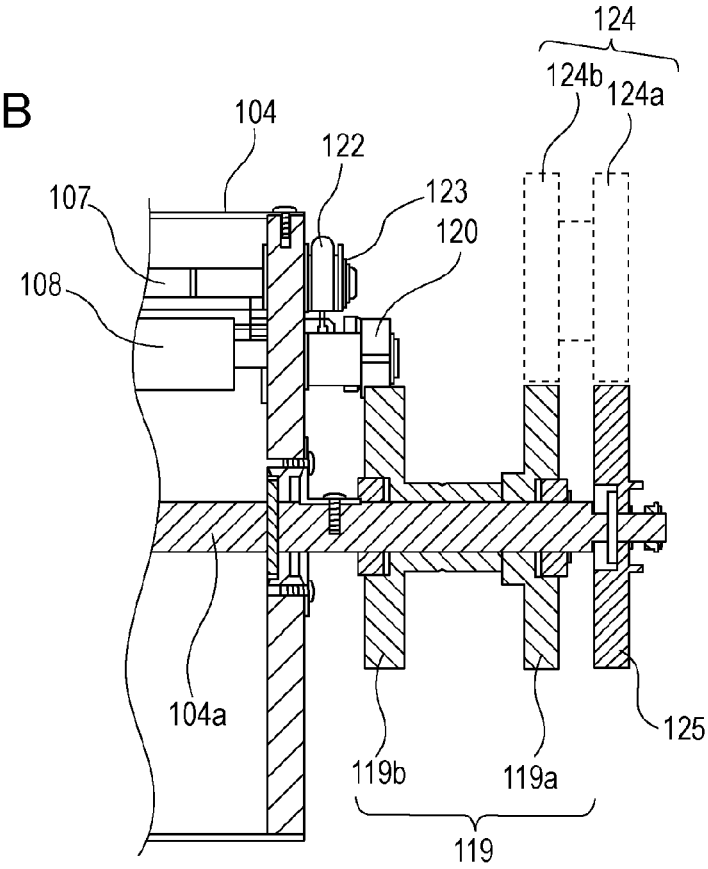

FIGS. 5A and 5B are perspective views illustrating the configuration of the driving mechanism of the winding rotary member 104. In FIG. 5A, the first driving mechanism is provided to the front side face side in the drawing of the winding rotary member 104, and the second driving mechanism is provided to the far side face side. FIG. 5B is a view as viewed from the opposite side of FIG. 5A, where the second driving mechanism is provided to the front side face side in the drawing of the winding rotary member 104, and the first driving mechanism is provided to the far side face side. FIGS. 6A and 6B illustrate the configuration of the principal portions of a second gear mechanism. FIG. 6A is a perspective view illustrating the hollow internal configuration excluding the winding face of the winding rotary member 104, and FIG. 6B is a cross-sectional view illustrating gear conjunction.

First, the first driving mechanism will be described. The first driving mechanism includes a first driving motor 109, and a first gear train for propagating the rotation of the first driving motor 109 to the rotating shaft of the winding rotary member 104. The first gear train includes a motor gear 109*a*, a gear 110, a clutch unit 111, a gear 112, a gear 113, and a drum gear 114. The clutch unit 111 is made up of an input gear 111*a*, an output gear 111*b*, and a clutch unit 111*c*, and is capable of management of driving transmission, and tension at the time of sheet winding. The driving transmission by the clutch unit 111 does not transmit input torque with 100% but transmits driving while the output gear 111*b* slips as to the input gear 111*a*, so as to transmit torque of a predetermined value. The rotation of the first driving motor 109 is decelerated by the first gear train with a predetermined gear ratio, and is transmitted to the drum gear 114. The drum gear 114 is fixed to a rotating shaft 104*a* serving as the rotation center of the winding rotary member 104, and the drum gear 114 and the winding rotary member 104 rotate in an integrated manner. At the time of sheet winding, the rotating speed of the winding rotary member 104 (the circumferential speed of the outer circumference of the wound sheet) is controlled so as to be greater than the transport speed of the sheet S to be led into the winding rotary member 104 by the conveying roller pair 151. This speed difference is absorbed by the output gear 111*b* slipping as to the input gear 111*a* of the clutch unit 111, and consequently, the rotating speed of the winding rotary member 104 becomes speed following the conveying roller pair 151. In other words, the sheet conveying speed at the time of sheet winding is principally determined by the conveying roller pair 151. Brake force affects the winding rotary member 104 from the conveying roller pair 151 via the sheet due to slip, and predetermined tension is applied to the sheet. The winding rotary member 104 rotates while being drawn with predetermined tension from the sheet to wind the sheet thereupon.

Next, the second driving mechanism will be described. The second driving mechanism includes a second driving motor 115, and a second gear train for propagating the rotation of the second driving motor 115 to the rotating shaft of the holding roller 108. The second gear train includes a motor gear 115*a*, a clutch unit 117, a gear 118, a transmission gear 119, a gear 120, and a roller gear 121. The clutch unit 117 is made up of an input gear 117*a*, an output gear 117*b*, and a clutch unit 117*c*, and is capable of switching of transmission and disconnection of rotating force. The rotation of the second driving motor 115 is decelerated by the second gear train with a predetermined gear ratio, and is transmitted to the roller gear 121. The roller gear 121 is fixed to a rotating shaft serving as the rotation center of the holding roller 108, and the roller gear 121 and the holding roller 108 rotate in an integrated manner. The transmission gear 119 includes an input gear 119*a* and an output gear 119*b* which are integrated. With both of the input gear 119*a* and the output gear 119*b*, the rotation center is matched with the rotating shaft 104*a* of the winding rotary member 104, and also rotatably performs empty rotation as to the rotating shaft 104*a*. A locking gear 125 is fixed to the edge portion of the rotating shaft 104*a*. A clutch unit 124 capable of switching transmission/disconnection of force is connected between the locking gear 125 and the transmission gear 119. The clutch unit 124 includes an input gear 124*a* to be geared with the locking gear 125, and an output gear 124*b* to be geared with the input gear 119*a*. Specifically, two of the gear 118 and the output gear 124*b* are geared with the input gear 119*a*.

Note that both edge portions of the rotating shaft of the pinch roller 107 are rotatably supported by a pinch roller bearing 123. Pressing force is given downward to the pinch roller bearing 123 by a pinch roller spring 122, and thus, the pinch roller 107 presses the holding roller 108.

With the above configuration, at the time of the holding roller 108 being rotated by the second driving motor 115, the clutch unit 117 is changed to a connection state, and also the clutch unit 124 is changed to a disconnected state. Upon driving the second driving motor 115 in this state, the rotation of the second driving motor 115 is transmitted to the roller gear 121 via the gear 120, and the holding roller 108 rotates (rotates on its axis). Note that, with the present example, the holding roller 108 which is one roller making up the holding roller pair 150 is arranged to be driven by the second driving motor 115, but the pinch roller 107 side may be driven. Alternatively, both of the holding roller 108 and the pinch roller 107 may be driven.

At the time of winding the sheet S around the winding rotary member 104, a state needs to be provided wherein the holding roller 108 is not rotated while the leading edge of the sheet S is nipped with the holding roller pair 150 (state locked with the winding rotary member 104). In this case, the clutch unit 117 is set to a disconnected state to disconnect rotating force from the second motor, and also the clutch unit 124 is set to a connected state. Thus, the transmission gear 119 is in a rotating state with constant speed along with the locking gear 125, i.e., the transmission gear 119 is in a state not relatively rotated as to the rotating shaft 104*a* (state in which this can be substantially regarded as an integral object). In response to this, the gear 120 and the holding roller 108 also are in a state not relatively rotated as to the winding rotary member 104 (state not rotated on its axis). Upon driving the first driving motor 109 in this state, the rotation of the first driving motor 109 is transmitted to the drum gear 114, the winding rotary member 104 rotates, and the sheet S can be wound around the winding rotary member 104. At this time, the holding roller 108 is not rotated on its axis but remains stationary.

Figure 7:
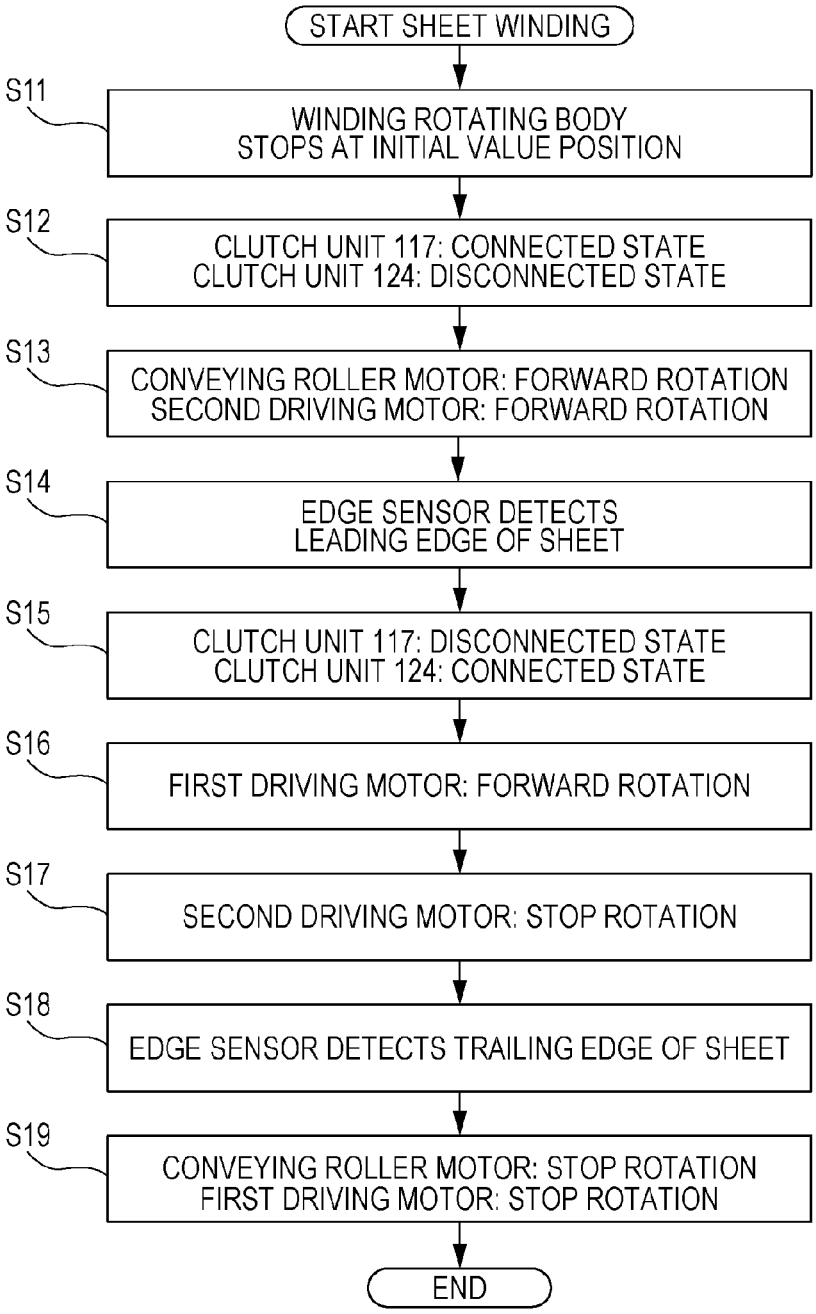
FIG. 7 is a flowchart illustrating operation sequence at the time of winding a sheet around the winding rotary member.
Figure 9A:
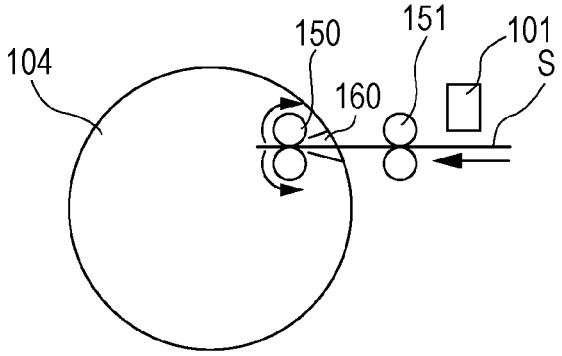
FIGS. 9A through 9C are diagrams for describing the operation with the sequence in FIG. 7.
Figure 9B:
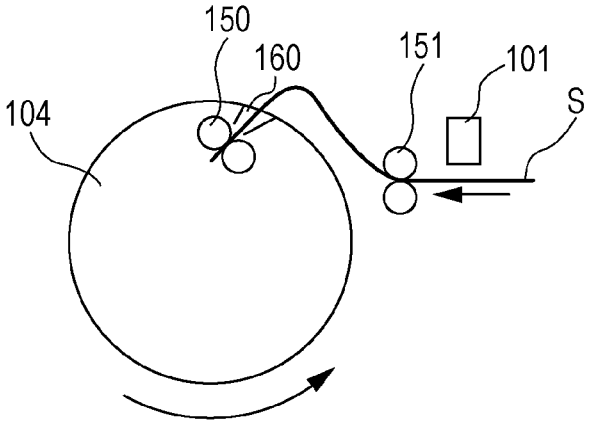
Figure 9C:
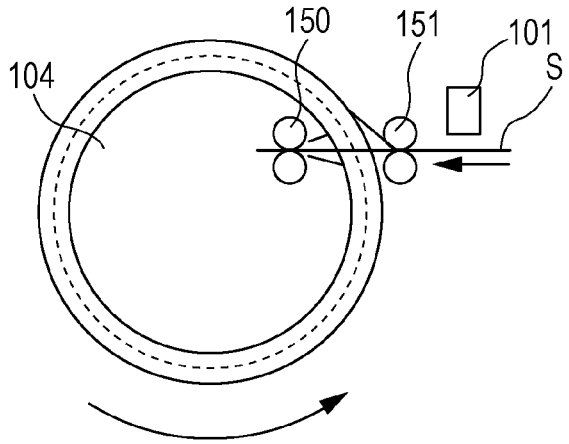

Next, the specific operation of the reverse unit 9 with duplex printing will be described. FIG. 7 is a flowchart illustrating operation sequence at the time of winding a sheet around the winding rotary member of the reverse unit 9, and FIGS. 9A through 9C are diagrams for describing the operation at that time.

In step S11, at the time of starting front face printing in the duplex print mode, the winding rotary member 104 is rotated so that the direction of the winding rotary member 104 is in a stationary state in an initial position such as illustrated in FIG. 4. With the initial position, the sheet insertion unit 160 faces the lead-in path of the sheet S, and the sheet S to be led into the winding rotary member 104 is smoothly inserted into the sheet insertion unit 160.

In step S12, the clutch unit 117 is set to a connected state, and the clutch unit 124 is set to a disconnected state. The holding roller 108 is in a state rotatable as to the winding rotary member 104.

In step S13, the conveying motor of the conveying roller 102 is driven so that the conveying roller 102 rotates in the forward direction (sheet winding direction), and the second driving motor 115 is driven so that the holding roller 108 rotates in the forward direction (direction where the sheet is drawn into the winding rotary member). At this time, control is preformed so that the feeding speed by the conveying roller 102, and the feeding speed by the holding roller 108 become equal speed.

In step S14, the edge sensor 101 detects that the leading edge of the sheet S passes through, and in the event of detecting this, conveys the sheet S to a position where the leading edge of the sheet S passes through the nipped portion of the holding roller pair 150 (state in FIG. 9A).

In step S15, the clutch unit 117 is set to a disconnected state, and the clutch unit 124 is set to a connected state. The holding roller 108 is in a stationary state as to the winding rotary member 104.

In step S16, the first driving motor 109 is driven so as to be rotated in the forward direction (sheet winding direction), and winding the sheet S around the winding rotary member 104 is stared (state in FIG. 9B).

In step S17, after predetermined amount of time has elapsed since the rotation of the first driving motor 109 was started, the rotation of the second driving motor 115 is stopped. Continuously, the rotation of the first driving motor 109 is continued, and sheet winding is continued. As the length of the wound sheet increases, the wound thickness of the sheet to be wound around the winding rotary member 104 increases (state in FIG. 9C).

The speed of the sheet being led in is constant, so the winding speed of the sheet needs to be kept constant in accordance therewith. Therefore, at the time of sheet winding, the rotation speed of the first driving motor is set beforehand so as to be greater than the conveying speed of the sheet S to be led into the winding rotary member 104 by the conveying roller pair 151. The output gear 111*b* slips as to the input gear 111*a* at the clutch unit 111, so even if the wound thickness of the sheet increases, the rotation speed of the winding rotary member 104 keeps constant speed following the conveying roller pair 151.

The conveying roller pair 151 is a portion of a conveying mechanism for leading the sheet into the winding rotary member. At the time of winding the sheet led in by the conveying roller pair 151 around the winding rotary member 104, the conveying roller pair 151 and the first driving mechanism are correlated so that the sheet winding speed (circumferential speed) by the rotation speed of the winding rotary member 104 is greater than the sheet conveying speed by the conveying roller pair 151, and also the conveying roller pair 151 has the initiative for the whole sheet conveying speed. That the conveying roller pair 151 has the initiative means that the whole sheet conveying speed is principally determined with the speed of the conveying roller pair 151. Regardless of the wound thickness of the sheet wound around the winding rotary member 104, the sheet winding speed by the winding rotary member 104 is set so as to be greater than the sheet conveying speed by the conveying roller pair 151.

As for another method, in order to prevent the rotation circumferential speed of the outer circumference of the sheet (sheet winding speed) from being changed even if the wound thickness of the wound sheet increases, control may be performed so that the rotational angular speed of the first driving motor is gradually decreased along increase of the wound thickness. Information relating to the wound thickness of the sheet can be obtained from the sheet length of the wound sheet.

Upon all of printing to the front face of the sheet being completed, the trailing edge of the sheet is cut off by the cutter, and winding at the reverse unit 9 is continued.

In step S18, the trailing edge of the sheet S to be led in (the leading edge of the sheet printed on the front face and cut off) is detected by the edge sensor 101. At the time of the leading edge of the sheet S passing through the sensor detection position, the signal output of the edge sensor 101 is changed from "ON: sheet exists" to "OFF: no sheet". The edge of the sheet is detected by capturing the change thereof. Upon detecting the edge of the sheet, the flow proceeds to step S19.

In step S19, the rotation of the conveying motor of the conveying roller 102 is stopped, and further, the rotation of the first driving motor 109 is also stopped. The position where the sheet S to be led in is stopped is a position where the trailing edge of the sheet S detected at the edge sensor 101 is kept in a nipped state at the conveying roller pair 151. This is for facilitating feeding out of the subsequent sheet. In this way, the sheet winding operation with front face printing ends.

Figure 10A:
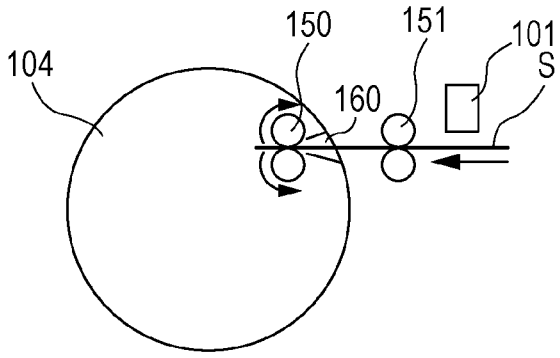
FIGS. 10A through 10C are diagrams for describing the behavior of another mode at the time of leading in a sheet.
Figure 10B:
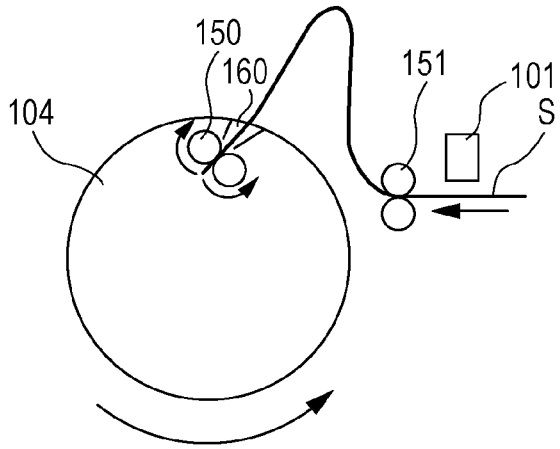
Figure 10C:
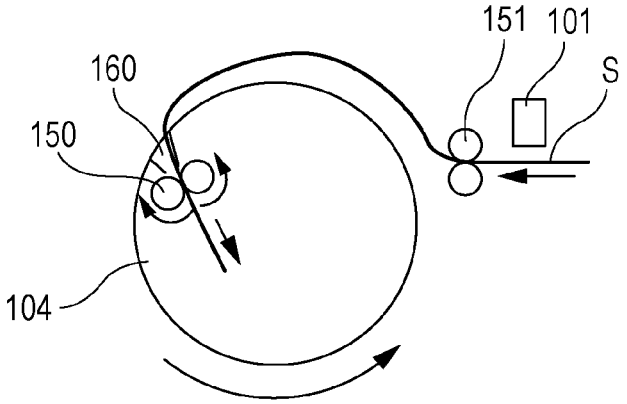

FIGS. 10A through 10C are diagrams for describing the behavior of another mode at the time of leading in a sheet. As the lead-in speed of the sheet S by the conveying roller pair 151 increases, the amount of the sheet S to be fed in increases during operation time to clamp with the holding roller pair 150 by inserting the leading edge of the sheet S into the sheet insertion unit 160 (state in FIG. 10A). Therefore, there is a possibility that a loop (slack) may be caused on the sheet between the conveying roller pair 151 and the holding roller pair 150 (state in FIG. 10B). Increase in the loop can cause faulty winding. Therefore, the generated loop can be eliminated by prolonging time for the holding roller 108 to rotate at the time of starting sheet winding (state in FIG. 10C). The time for the holding roller 108 to rotate is determined from time used for clamping of the leading edge of the sheet S, sheet conveying speed by the conveying roller pair 151, and the rotating speed of the holding roller 108.

Figure 8:
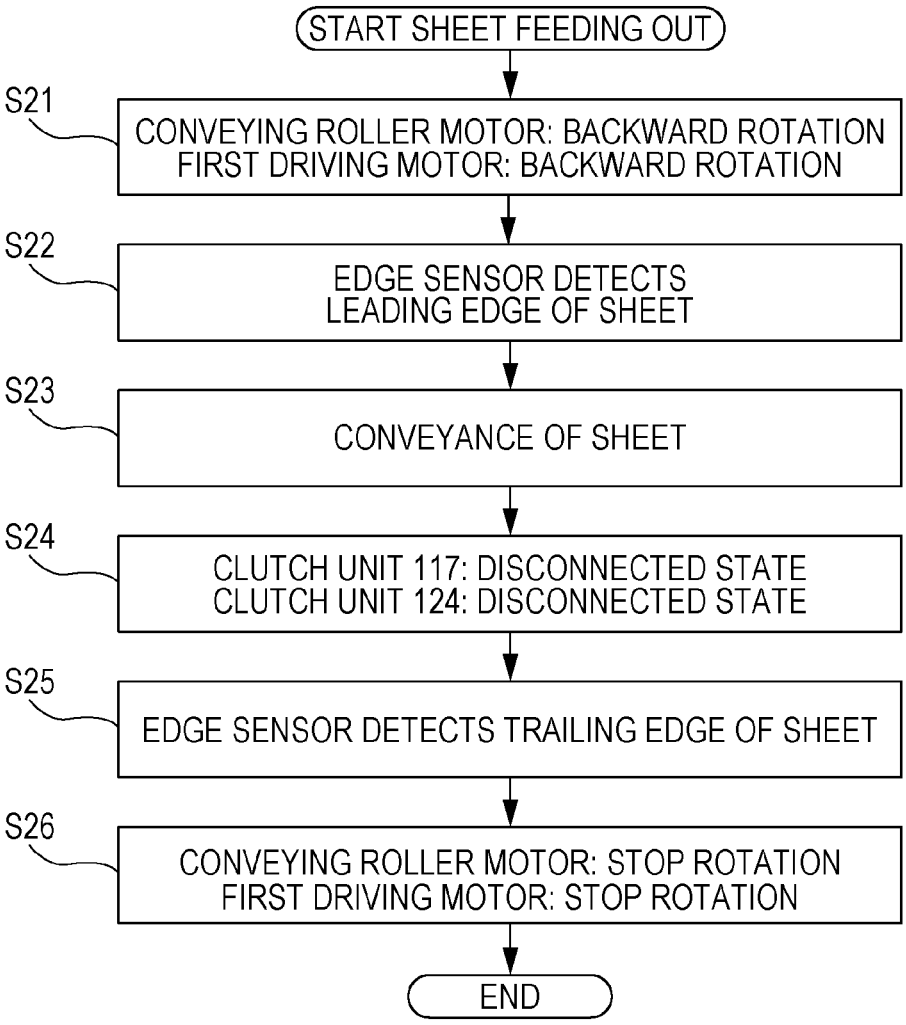
FIG. 8 is a flowchart illustrating operation sequence at the time of feeding out a sheet from the winding rotary member.

Back face printing is performed following the above winding operation. FIG. 8 is a flowchart illustrating operation sequence at the time of feeding out a sheet from the winding rotary member.

In step S21, the conveying motor of the conveying roller 102 is driven so as to be rotated in the opposite direction (sheet feeding out direction), and the first driving motor 109 is driven so as to be rotated in the opposite direction (sheet winding direction).

In step S22, upon feeding out of the sheet being started from the winding rotary member, the leading edge (the most trailing edge of the sheet printed on the front face and cut off) of the sheet S to be fed out is detected by the edge sensor 101. At the time of the leading edge of the sheet S passing through the sensor detection position, the signal output of the edge sensor 101 is changed from "OFF: no sheet" to "ON: sheet exists". The edge of the sheet is detected by capturing the change thereof. Upon detecting the edge of the sheet, the flow proceeds to step S23.

In step S23, the conveying amount of the sheet (the sheet length of the sheet fed out) is counted with the detection in step S22 as a basic point, and conveyance of the sheet is continued until the count reaches a predetermined value. The predetermined value is the sheet length of the sheet wound around the winding rotary member 104.

The speed of the sheet to be fed out toward the print unit 4 is constant, so the winding speed of the sheet from the winding rotary member 104 needs to be kept constant in accordance therewith. Therefore, at the time of sheet winding out, the rotation speed of the first driving motor is set beforehand so as to be smaller than the conveying speed of the sheet S to be conveyed by the conveying roller pair 151. The output gear 111*b* slips as to the input gear 111*a* at the clutch unit 111, so even if the wound thickness of the sheet decreases, the rotation speed of the winding rotary member 104 keeps constant speed following the conveying roller pair 151.

The conveying roller pair 151 is a portion of a conveying mechanism for discharging the sheet from the winding rotary member 104. At the time of discharging the sheet wound out from the winding rotary member 104 by the conveying roller pair 151, the conveying roller pair 151 and the first driving mechanism are correlated so that the winding out speed (circumferential speed) by the rotation speed of the winding rotary member 104 is smaller than the sheet conveying speed by the conveying roller pair 151, and also the conveying roller pair 151 has the initiative for the whole sheet conveying speed (discharge speed). Regardless of the wound thickness of the sheet wound around the winding rotary member 104, the sheet winding out speed by the winding rotary member 104 is set so as to be smaller than the sheet conveying speed by the conveying roller pair 151.

As for another method, in order to prevent the rotation circumferential speed of the outer circumference of the sheet (sheet winding speed) from being changed even if the wound thickness of the wound sheet decreases, control may be performed so that the rotational angular speed of the first driving motor is gradually increased along decrease in the wound thickness. Information relating to the wound thickness of the sheet can be obtained from the sheet length of the sheet fed out.

In step S24, at timing immediately before the trailing edge of the sheet S exits from the nip of the holding roller pair 150, the clutch unit 117 is set to a disconnected state, and the clutch unit 124 is set to a disconnected state. Both clutches are in a disconnected state, so the holding roller 108 is in a rotatable state free from both of the second driving motor 115 and the winding rotary member 104. Accordingly, both of the holding roller 108 and the pinch roller 107 are driven as to the sheet S to be paid out, and the trailing edge of the sheet S can exit from the nip of the holding roller pair 150 with little resistance.

In step S25, the trailing edge of the sheet S to be fed out is detected by the edge sensor 101. At the time of the trailing edge of the sheet S passing through the sensor detection position, the signal output of the edge sensor 101 is changed from "ON: sheet exists" to "OFF: no sheet". The edge of the sheet is detected by capturing the change thereof. Upon detecting the edge of the sheet, the flow proceeds to step S26.

In step S26, the rotation of the conveying motor of the conveying roller 102 is stopped, and further, the rotation of the first driving motor 109 is also stopped. In this way sheet, the feeding out operation with back face printing ends. In this way, the fed out sheet has been subjected to back face printing, and both face printing has been completed.

As described above, at the time of the sheet S led in being inserted into the nip of the holding roller pair 150, the holding roller 108 rotates in a direction where the sheet leading edge is drawn in, so clamping of the sheet S as to the winding rotary member 104 is performed in a sure manner. Subsequently, at the time of sheet winding, the holding roller 108 is in a state in which the rotation is relatively stationary as to the winding rotary member 104, so sheet winding is stably performed in a state in which the sheet S is clamped in a sure manner. At the time of winding out the sheet from the winding rotary member 104, the holding roller 108 is driven-rotated free as the sheet, so the trailing edge of the sheet S can smoothly exit from the nip of the holding roller pair 150.

Note that at the time of the trailing edge of the sheet S exiting the holding roller pair 150, regardless of a mode wherein the holding roller pair 150 being passively rotated, the holding roller pair 150 may actively be rotated. In order to realize this, before the trailing edge of the sheet S exits the nip of the holding roller pair 150, the clutch unit 117 is set a connected state, and the clutch unit 124 is set to a disconnected state. Subsequently, the second driving motor 115 is rotated in the opposite direction of the direction at the time of lead-in, and the sheet S nipped with the holding roller pair 150 is actively discharged. Let us say that the discharge speed at this time is the same speed as the sheet conveying speed by the conveying roller pair 151. When the edge sensor 101 detects the passage of the sheet edge portion, the rotation of the second driving motor 115, and the rotation of the conveying motor of the conveying roller 102 are stopped. In this way, the holding roller 108 is actively rotated, whereby the trailing edge of the sheet S can smoothly exit from the nip of the holding roller pair 150.

Figure 14:
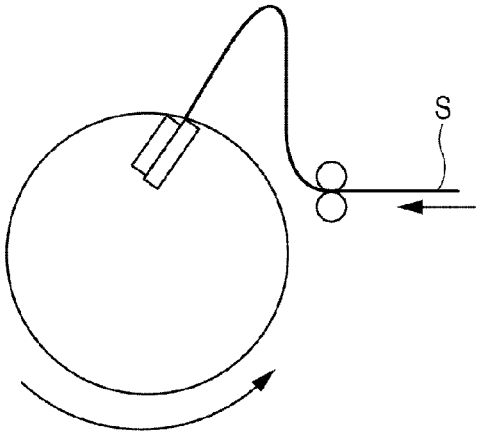
FIG. 14 is a diagram for describing loop occurrence of a sheet at the time of winding.

As described above, lead-in and discharge of a sheet is smoothly performed without scratching the sheet leading edge by using the holding roller pair 150 which is a rotatable holder capable of nipping the sheet leading edge and also rotation. In addition, no loop (slack) occurs on a sheet with the initial stage of winding such as illustrated in FIG. 14. Accordingly, the sheet can be wound in a sure manner.

Incidentally, at the time of a sheet being wound around the winding rotary member 104, when the sheet is obliquely led in (skewing occurs on the sheet), there is a possibility that the sheet may be wound around the winding rotary member 104 in an inclined manner. In order to prevent this, a skew correcting unit for correcting skewing before a sheet to be led in for being wound around the winding rotary member 104 is nipped with the rotatable holder is provided to the reverse unit 9.

Figure 11A:
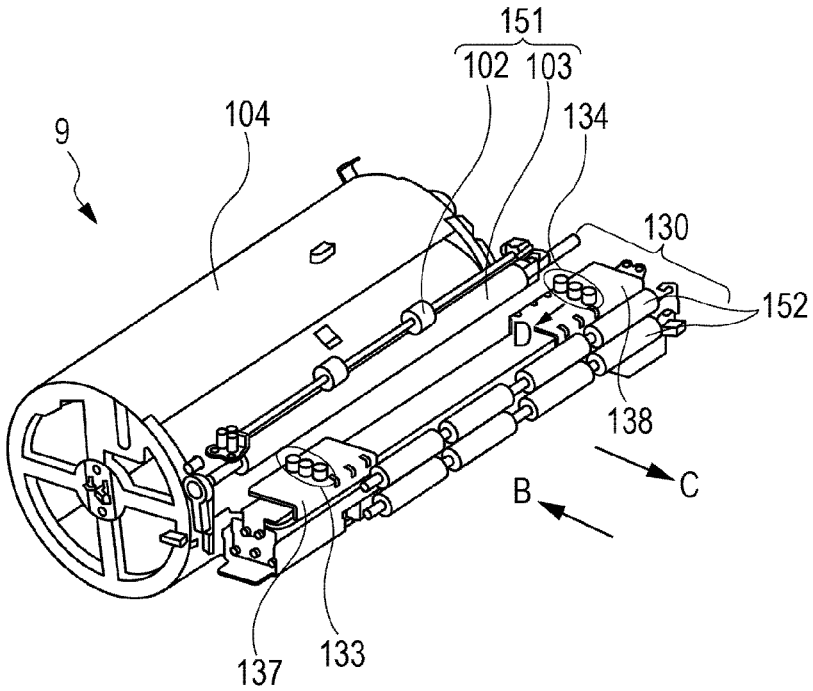
FIGS. 11A and 11B are perspective views of a winding portion and a skew correcting unit.
Figure 11B:
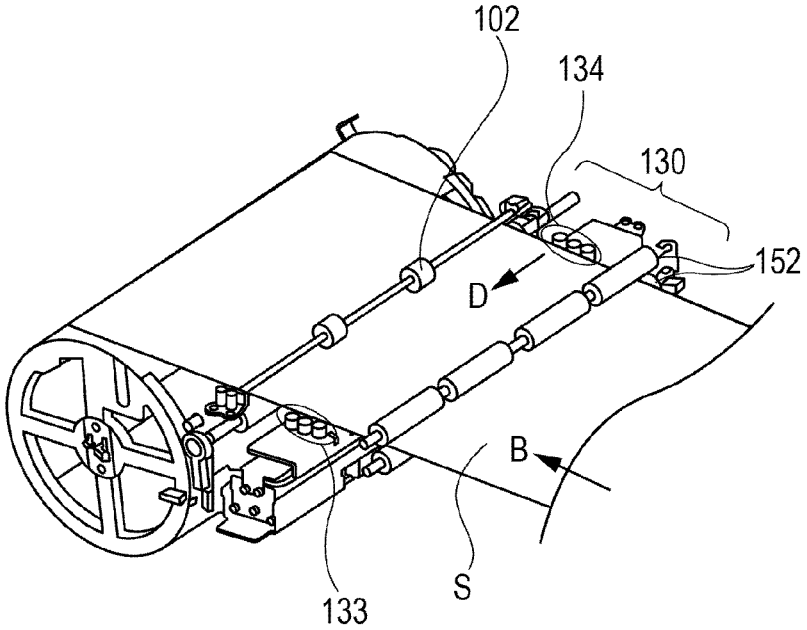

FIGS. 11A and 11B are perspective views for describing the configuration of the skew correcting unit provided in front of the winding rotary member 104. In FIG. 11A, a skew correcting unit 130 is provided in front of the winding rotary member 104, and further in front of the conveying roller pair 151 in front thereof. The skew correcting unit 130 includes a first correction roller 133, a second correction roller 134, a conveying roller pair 152, and upper and lower guide plates (not illustrated). With the conveying roller pair 151 and the conveying roller pair 152, rotation is individually controlled. These conveying rollers may individually be rotated by separate driving sources, or may be rotated by switching driving force from the same driving source using a clutch or the like.

With the first correction roller 133, multiple (three here) small rollers (driven rollers) of which the rotating shafts are perpendicular to the faces of the sheet are arrayed in the sheet conveying direction, and each small roller can be in contact with one sheet side portion of the sheet S to be conveyed. The second correction roller 134 also has the same configuration as the first correction roller 133, which can be in contact with the other sheet side portion of the sheet S. Also, though not illustrated in FIG. 11A, guide plates for guiding the faces of the sheet S to be passed through from the upward and downward are proved between the first correction roller 133 (second correction roller 134) and the conveying roller pair 151 in the sheet conveying direction.

FIG. 11B illustrates a scene at the time of subjecting the sheet being led in to skew correction. The first correction roller 133 is a reference side, and the second correction roller 134 presses the sheet side portion of the sheet S in the width direction of the sheet S (D direction in the drawing) via an elastic member such as a spring or the like. The positioning of the sheet S in the sheet width direction is performed following the first correction roller 133 serving as the reference, and also skewing (tilt) of the sheet as to the true sheet conveying direction is corrected.

Figure 12A:
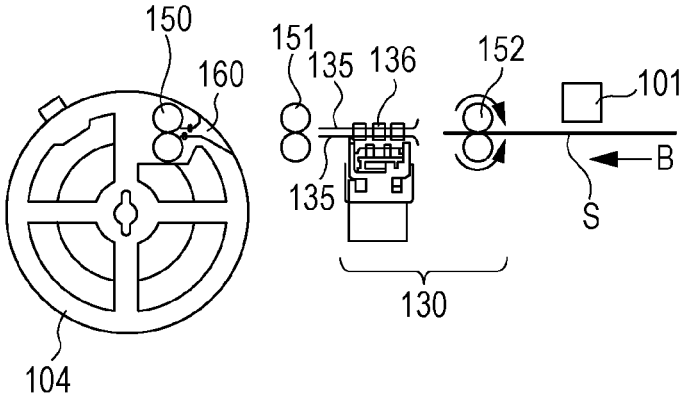
FIGS. 12A through 12C are diagrams for describing operation with skew correcting operation.
Figure 12B:
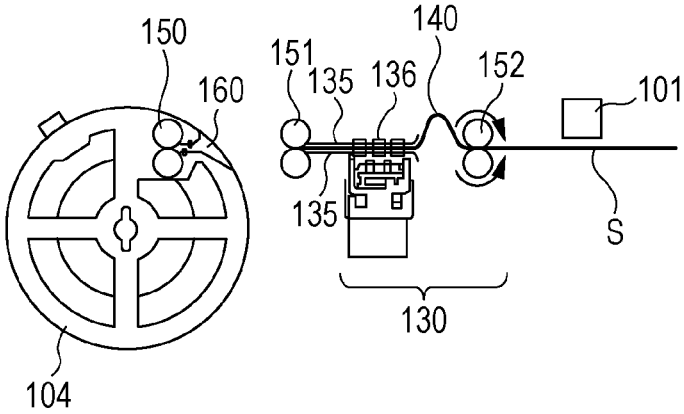
Figure 12C:
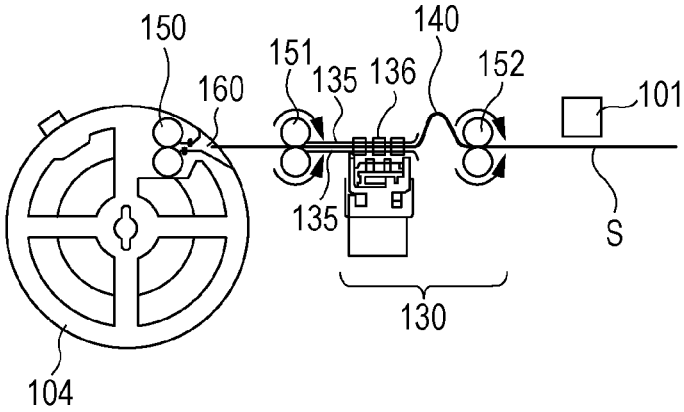

Operation sequence is employed to perform skew correction in a more effectively manner wherein after a loop (slack) is formed in the sheet S between the first correction roller 133 and the second correction roller 134, and the conveying roller pair 152, skew correction is performed. FIGS. 12A through 12C are diagrams for describing operation to perform skew correction by causing a loop.

FIG. 12A illustrates a state in which the sheet is led in from a B direction, and the leading edge of the sheet S is nipped with the conveying roller pair 152 on the upstream side. At this time, with the conveying roller pair 151 on the downstream side, rotation is stopped. The sheet S further advances from here, passes through a gap of the upper and lower guide plates 135, and reaches the conveying roller pair 151. The conveying roller pair 151 is stationary, so the advancement of the sheet leading edge is stopped here, but the subsequent sheet is continuously fed by the conveying roller pair 152.

FIG. 12B illustrates a scene in which a loop 140 is formed on the sheet S by continuously feeding the sheet by the conveying roller pair 152 in a state wherein the sheet leading edge is stationary. The loop 140 occurs only a region between the conveying roller pair 152 and the first correction roller 133 (second correction roller 134). Between the first correction roller 133 (second correction roller 134) and the conveying roller pair 151 the sheet S is guided from the upward and downward by the guide plates 135, so no loop occurs in this region of the sheet. After a desired loop is formed, the conveying roller pair 151 which has been stationary starts rotation.

FIG. 12C illustrates a state in which the conveying roller pair 151 which has been stationary starts rotation. The conveying roller pair 151 and the conveying roller pair 152 convey the sheet S at the same speed. Therefore, the sheet is wound while the loop 140 keeps the same size.

With the sheet S to be led in, the positioning of the sheet in the sheet width direction is performed between the first correction roller 133 and the second correction roller 134, and also skewing (tilt) of the sheet as to the true sheet conveying direction is corrected. At this time, the loop 140 having a suitable size is constantly formed in the near side of the sheet S, so the twist of the sheet due to skew correction is absorbed at the loop 140, and skew correction is smoothly performed without unreasonable force being applied to the sheet. The twist is absorbed at the loop 140, so the first correction roller 133 and the second correction roller 134 may have smaller force pressing the sheet side portion, and damage and conveyance resistance as to the sheet due to pressing can be prevented.

In this way, the sheet subjected to positioning in the sheet width direction and skew correction is led into a correct position from a straight direction as to the winding rotary member 104 without meandering, and the sheet is wound in an extremely accurate manner. The accurately wound sheet is also fed out to a correct position straightly without meandering at the time of sheet feeding out with back face printing. Note that at the time of sheet feeding out, skew correction does not have to be performed, so the first correction roller 133 and the second correction roller 134 are evacuated in a mutually separated direction to avoid coming into contact with the sheet, thereby preventing conveyance resistance from occurring.

Figure 13:
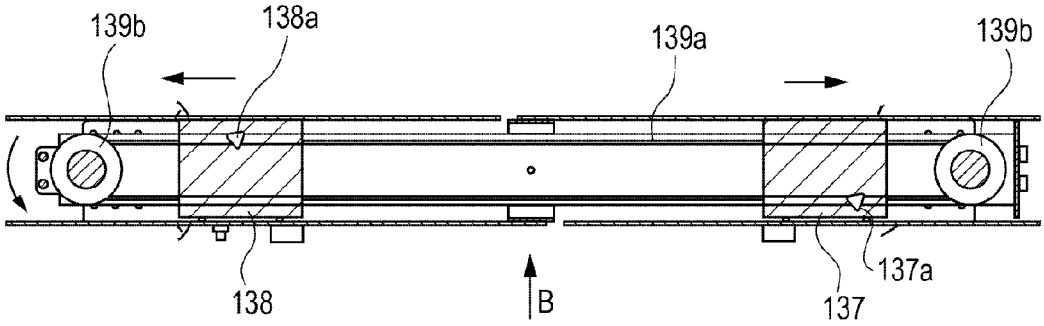
FIG. 13 is a diagram illustrating the configuration of an adjustment mechanism for adjusting the interval of correction rollers.

FIG. 13 is a diagram illustrating an adjustment mechanism for moving the first correction roller 133 and the second correction roller 134 in the sheet width direction to change the interval therebetween. The first correction roller 133 is mounted on a base 137, and the second correction roller 134 is mounted on a base 138. Each of the base 137 and the base 138 can be moved in the lateral direction in the drawing by a driving mechanism made up of a driving belt 139*a*, and two pulleys 139*b*. One or both of the two pulleys 139*b* is connected to the driving power source so as to rotate. The base 137 is clamped with the driving belt 139*a* at a position 137*a*, and the base 138 is clamped with the driving belt 139*a* at a position 138*a*. The position 137*a* and the position 138*a* are sides where the belt faces. With this configuration, upon the pulley 139*b* being rotated in an arrow direction in the drawing (counterclockwise), the driving belt 139*a* is also rotated counterclockwise, and the base 137 and the base 138 are moved in a mutually separated direction (direction where the interval increases). Upon the pulley 139*b* being rotated in the reverse direction (clockwise), the driving belt 139*a* is rotated clockwise, and the base 137 and the base 138 are moved in a mutually approaching direction (direction where the interval decreases).

As described above, at the time of sheet lead-in, the interval of the first correction roller 133 and the second correction roller 134 is set so as to be matched with the sheet width of the sheet S to be used, and suitable pressing force is applied from both sides of the sheet S. Also, at the time of sheet feeding out, the interval of the first correction roller 133 and the second correction roller 134 is set widely so as not to be in contact with the sheet. The adjustment of these intervals is controlled by the control unit 13 of the printing apparatus.

At the time of performing duplex printing with the printing apparatus according to the above-mentioned present embodiment, the sheet fed from the sheet feeding unit 1 is subjected to first skew correction at the skew correcting unit 3 in front of the print unit 4. The sheet of which the first surface has been printed is subjected to second skew correction before being led into the reverse unit 9. At the time of the subsequent back face printing, the sheet fed out from the reverse unit 9 is subjected to third skew correction at the skew correcting unit 3 in front of the print unit 4. In this way, at the time of performing duplex printing, three times of skew correction in total is performed at two places sensitive about position shift in the sheet width direction and skewing, whereby the print results of high-quality duplex printing are obtained. In particular, with duplex printing, it is required that a front face image and a back face image are accurately aligned on both sides of the sheet, and accordingly, it is very effective to perform three times of skew correction at principal portions as described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042340 filed Feb. 26, 2010, which is hereby incorporated by reference herein in its entirety.

What is claimed is:

1. A device capable of winding a sheet thereupon, the device comprising:

a winding rotary member having a cylindrical shape;

a holder having a rotating member that is provided in a vicinity of a cylindrical surface of the winding rotary member, wherein the holder is capable of nipping and conveying a sheet;

a detecting unit configured to detect an initial position of rotation of the winding rotary member relative to a lead-in path for the sheet to be lead into an internal space within the winding rotary member;

a first driving mechanism configured to rotate the winding rotary member; and a second driving mechanism configured to rotate the rotating member, wherein the first driving mechanism rotates the winding rotary member with the sheet nipped by the holder, whereby the sheet is wound around the winding rotary member, wherein the first driving mechanism and the second driving mechanism operate at the same time, wherein the second driving mechanism coordinates rotation of the holder with rotation of the winding rotary member so that the holder draws the sheet into the internal space while the sheet is wound around the winding rotary member to reduce a possibility of a loop caused on a section of the sheet before the section of the sheet reaches the winding rotary member, and wherein, after a state in which the first driving mechanism and the second driving mechanism operate at the same time, the first driving mechanism continues its operation and the second driving mechanism stops its operation, whereby the holder stops drawing the sheet into the winding rotary member while the sheet is wound around the winding rotary member, wherein the winding rotary member is configured such that, a sheet winding speed, determined by a rotating speed of the winding rotary member, is maintained at a speed that is greater than a sheet conveying speed of the sheet received by the winding rotary member, whereby a whole sheet conveying speed principally is determined by the speed of the sheet conveying speed of the sheet to the winding rotary member.

2. The device according to claim 1, wherein the sheet is wound around the winding rotary member at least one round.

3. The device according to claim 1, further comprising:

a sensor configured to detect an edge of a sheet to be fed to the winding rotary member along the lead-in path for the sheet, wherein the operation of the second driving mechanism is based on detection at the sensor.

4. The device according to claim 3, wherein the initial position of rotation of the winding rotary member is where a sheet insertion unit leading from the cylindrical surface of the winding rotary member to the holder faces the lead-in path of the sheet from the sensor, wherein the sheet is led into the winding rotary member at the detected initial position in a state in which the winding rotary member is stationary, and a leading edge of the sheet subsequently is nipped by the holder, and wherein the holder is a rotatable holder.

5. The device according to claim 1, wherein the first driving mechanism includes a first driving motor, and a first gear train configured to transmit rotation of the first driving motor to a rotating shaft of the winding rotary member, and wherein the second driving mechanism includes a second driving motor, and a second gear train configured to transmit rotation of the second driving motor to the rotating member of the holder.

6. The device according to claim 5, wherein the first driving mechanism is provided to one side of the winding rotary member, and the second driving mechanism is provided to an other side of the winding rotary member.

7. The device according to claim 5, wherein the second gear train includes:

a first gear configured to transmit the rotation of the second driving motor, a second gear, which is rotatably provided to a side of the winding rotary member and is matched with the winding rotary member regarding a rotation center, to which the rotation of the first gear is transmitted, and a third gear, which is rotatably provided to the side of the winding rotary member and is unmatched with the winding rotary member regarding the rotation center, configured to transmit the rotation of the second gear to the rotating member of the holder.

8. An apparatus comprising:

a sheet feeding unit;

a processing unit configured to subject a sheet to be fed from the sheet feeding unit to predetermined processing; and the device according to claim 1 configured to wind the sheet processed at the processing unit thereupon.

9. The apparatus according to claim 8, wherein the predetermined processing includes at least one of printing, recording, processing, coating, irradiation, scanning, and inspection as to a sheet.

10. An apparatus capable of duplex printing, the apparatus comprising:

a sheet feeding unit configured to hold and feed a continuous sheet;

a print unit configured to print on the sheet fed from the sheet feeding unit; and the device according to claim 1 configured to wind the sheet printed at the print unit thereupon, wherein, in the duplex printing, the print unit performs printing of a plurality of images on a first surface of the sheet fed from the sheet feeding unit and facing the print unit, the winding rotary member is rotated in a first direction to wind the printed sheet temporarily around the winding rotary member, and subsequently, the winding rotary member is rotated in a second direction that is opposite the first direction to feed the wound sheet to print unit so that a second surface of the sheet faces the print unit, and the print unit performs printing of a plurality of images on the second surface of the sheet fed from the sheet feeding unit, wherein the second surface is a back of the first surface of the sheet fed from the sheet feeding unit.

11. The device according to claim 1, further comprising a holding member, wherein the rotating member is configured to be pressed against the holding member and the rotating member and the holding member are located away from the cylindrical surface in the internal space within the winding rotary member.

12. The device according to claim 1, wherein the first driving mechanism and the second driving mechanism operate at the same time in response to a request to wind a sheet upon the cylindrical surface of the winding rotary member, the device further comprising a holding member, wherein the rotating member is configured to be pressed against the holding member and the rotating member and the holding member is located closer to a center of the winding rotary member than the rotating member.

13. The device according to claim 1, wherein the first driving mechanism rotates the winding rotary member with the sheet nipped by the holder, whereby the sheet is wound tightly around the winding rotary member.

14. A device capable of winding a sheet thereupon, the device comprising:

a winding rotary member having a cylindrical shape;

a holder having a rotating member that is provided in a vicinity of a cylindrical surface of the winding rotary member, wherein the holder is capable of nipping and conveying a sheet;

a detecting unit configured to detect an initial position of rotation of the winding rotary member relative to a lead-in path for the sheet to be lead into an internal space within the winding rotary member;

a first driving mechanism configured to rotate the winding rotary member;

a second driving mechanism configured to rotate the rotating member; and a conveying mechanism configured to lead the sheet into the winding rotary member, wherein the first driving mechanism rotates the winding rotary member with the sheet nipped by the holder, whereby the sheet is wound around the winding rotary member, and wherein the conveying mechanism and the first driving mechanism are correlated by receiving control signals so that, at a time of winding the sheet led in by the conveying mechanism around the winding rotary member, a sheet winding speed determined by a rotating speed of the winding rotary member is greater than a sheet conveying speed of the sheet by the conveying mechanism, whereby a whole sheet conveying speed principally is determined by the speed of the conveying mechanism.

15. The device according to claim 14, wherein, as a wound thickness of a roll of the sheet wound around the winding rotary member changes, the sheet winding speed by the winding rotary member is maintained to be greater than the sheet conveying speed by the conveying mechanism.

16. A device capable of winding a sheet thereupon, the device comprising:

a winding rotary member having a cylindrical shape;

a holder having a rotating member that is provided in a vicinity of a cylindrical surface of the winding rotary member, wherein the holder is capable of nipping and conveying a sheet;

a first driving mechanism configured to rotate the winding rotary member;

a second driving mechanism configured to rotate the rotating member; and a conveying mechanism configured to discharge the sheet from the winding rotary member, wherein the winding rotary member rotates with the sheet nipped by the holder, whereby the sheet is wound around the winding rotary member, and wherein the conveying mechanism and the first driving mechanism are correlated by receiving control signals so that, at a time of discharging the sheet wound out from the winding rotary member by the conveying mechanism, a sheet winding speed determined by a rotating speed of the winding rotary member is smaller than a sheet conveying speed by the conveying mechanism, whereby a whole sheet conveying speed of the sheet principally is determined by the speed of the conveying mechanism.

17. The device according to claim 16, wherein, as a wound thickness of a roll of the sheet wound around the winding rotary member changes, the sheet winding speed by the winding rotary member is maintained to be smaller than the sheet conveying speed by the conveying mechanism.

18. A device capable of winding a sheet thereupon, the device comprising:

a winding rotary member having a cylindrical shape;

a holder having a rotating member that is provided in a vicinity of a cylindrical surface of the winding rotary member, wherein the holder is capable of nipping and conveying a sheet;

a first driving mechanism configured to rotate the winding rotary member; and a second driving mechanism configured to rotate the rotating member, wherein the winding rotary member rotates with the sheet nipped by the holder, whereby the sheet is wound around the winding rotary member, and wherein a rotational angle speed of a driving motor included in the first driving mechanism is changed according to received control signals based on a wound thickness of a roll of the sheet wound around the winding rotary member.

* * * * *